US009226583B1

(12) United States Patent
Hibbard

(10) Patent No.: US 9,226,583 B1
(45) Date of Patent: Jan. 5, 2016

(54) FURNITURE HAVING REMOVABLE ARM SECTIONS

(71) Applicant: Phyllis W. Hibbard, Peterborough (CA)

(72) Inventor: Phyllis W. Hibbard, Peterborough (CA)

( * ) Notice: Subject to any disclaimer, the term of this patent is extended or adjusted under 35 U.S.C. 154(b) by 109 days.

(21) Appl. No.: 13/965,283

(22) Filed: Aug. 13, 2013

(51) Int. Cl.
*A47C 7/54* (2006.01)

(52) U.S. Cl.
CPC ..... *A47C 7/546* (2013.01)

(58) Field of Classification Search
CPC ..... A47C 7/546; A47C 7/02; A47C 13/005
USPC ..... 297/411.26, 411.27, 440.14, 444.1; 403/104–107, 109.8, 252, 253; 24/458, 24/591.1, 593.11; 248/220.21, 220.22, 248/221.11, 222.11
See application file for complete search history.

(56) References Cited

U.S. PATENT DOCUMENTS

| | | | | |
|---|---|---|---|---|
| 319,491 | A * | 6/1885 | King | 5/29 |
| 3,608,959 | A | 9/1971 | Sarvas | |
| 3,614,156 | A * | 10/1971 | Sarvas | 297/224 |
| 4,060,277 | A | 11/1977 | Leib | |
| D282,423 | S | 2/1986 | Carter | |
| 4,787,319 | A | 11/1988 | Dupraz | |
| 4,932,720 | A | 6/1990 | Sherman | |
| D364,749 | S | 12/1995 | McKnight | |
| 5,738,414 | A * | 4/1998 | Wieland et al. | 297/440.1 |
| 5,890,767 | A * | 4/1999 | Chang | 297/440.14 |
| 6,773,063 | B2 * | 8/2004 | Eerkens | 297/248 |
| 7,025,416 | B1 * | 4/2006 | Ramirez et al. | 297/160 |
| 7,252,339 | B2 * | 8/2007 | Owens | 297/440.1 |
| 7,963,612 | B2 | 6/2011 | Nelson | |
| 2002/0000026 | A1 * | 1/2002 | Noda | 24/458 |

FOREIGN PATENT DOCUMENTS

| | | | | |
|---|---|---|---|---|
| EP | 1386563 | A1 * | 2/2004 | A47C 13/00 |

* cited by examiner

*Primary Examiner* — David R Dunn
*Assistant Examiner* — Jody Giacoman

(57) ABSTRACT

A furniture device has removable arm sections to facilitate transport of the furniture through tight spaces. The device includes a base having an upper surface configured for supporting a person thereon. A back extends upwardly from the base. Each of a plurality of loops is coupled to an associated side face of the base. Each of a plurality of projections is coupled to and extends from an associated arm section. Each projection is insertable through an associated one of the loops wherein each arm section is removably couplable to the base by seating each projection in the associated loop.

4 Claims, 4 Drawing Sheets

FURNITURE HAVING REMOVABLE ARM SECTIONS

BACKGROUND OF THE DISCLOSURE

Field of the Disclosure

The disclosure relates to furniture devices and more particularly pertains to a new furniture device for selectively removing arm sections from furniture to facilitate transport of the furniture through tight spaces.

SUMMARY OF THE DISCLOSURE

An embodiment of the disclosure meets the needs presented above by generally comprising a base having an upper surface configured for supporting a person thereon. A back extends upwardly from the base. Each of a plurality of loops is coupled to an associated side face of the base. Each of a plurality of projections is coupled to and extends from an associated arm section. Each projection is insertable through an associated one of the loops wherein each arm section is removably couplable to the base by seating each projection in the associated loop.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
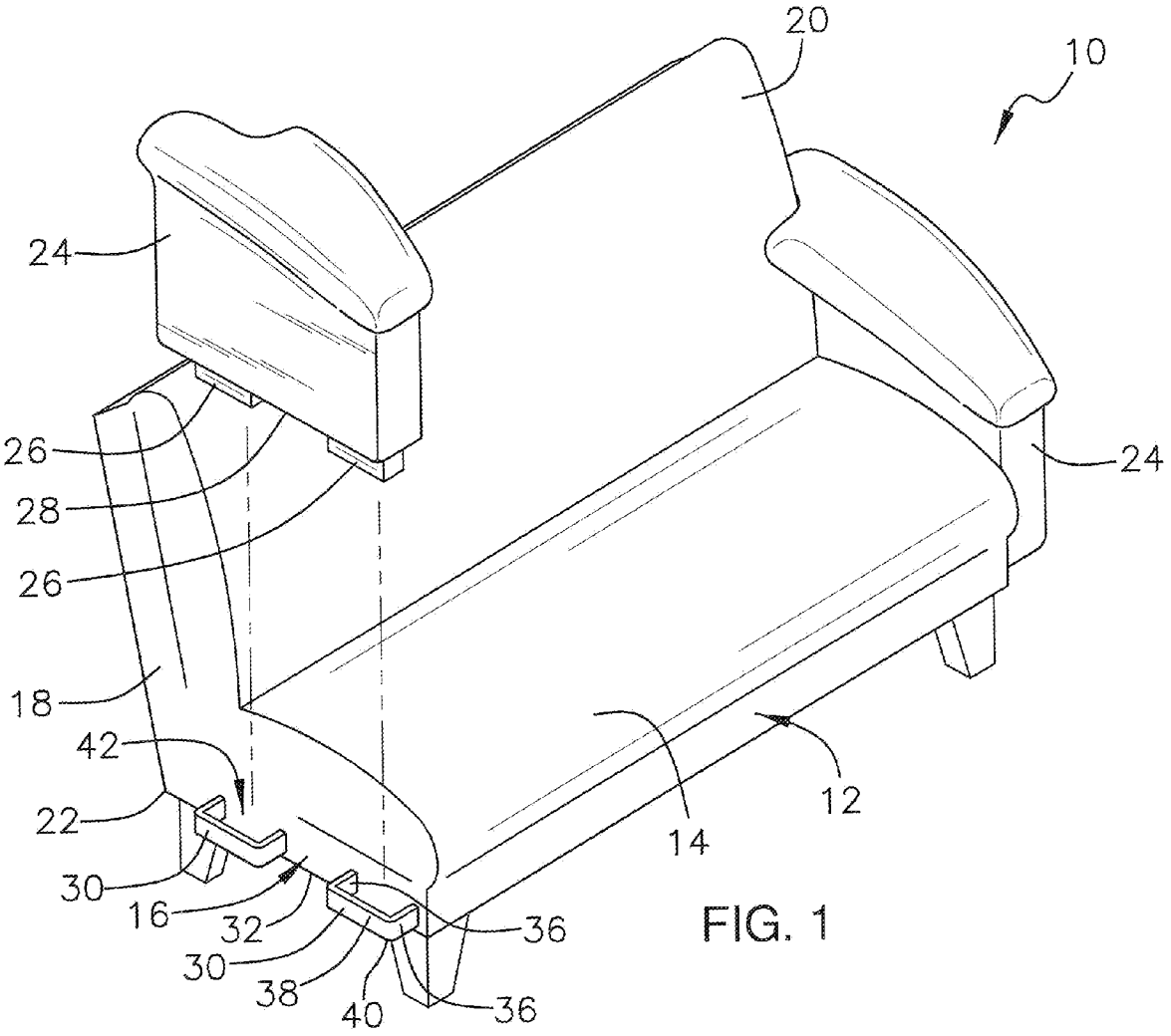
FIG. 1 is a partially exploded top front side perspective view of a furniture having removable arm sections according to an embodiment of the disclosure.
Figure 2:
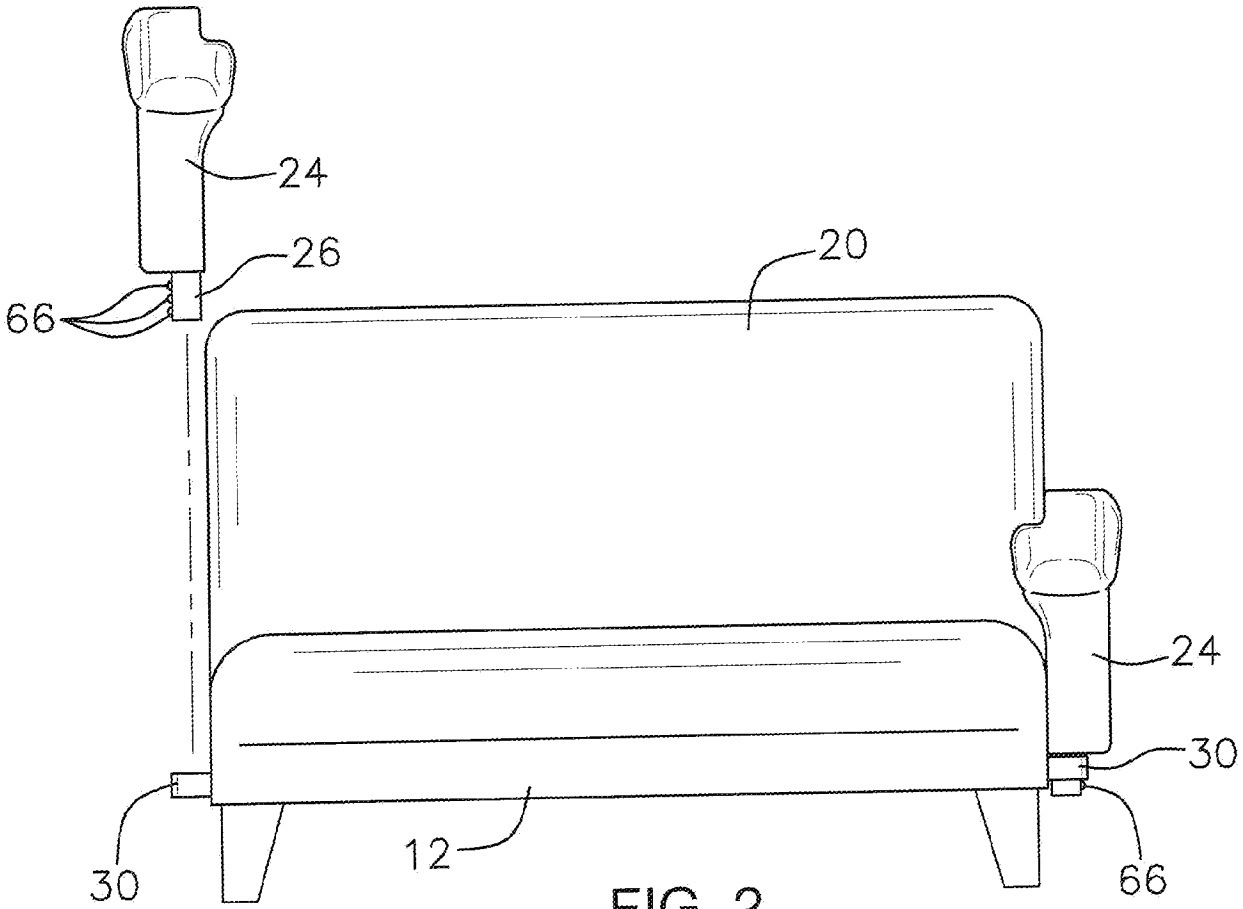
FIG. 2 is a partially exploded front view of an embodiment of the disclosure.
Figure 4:
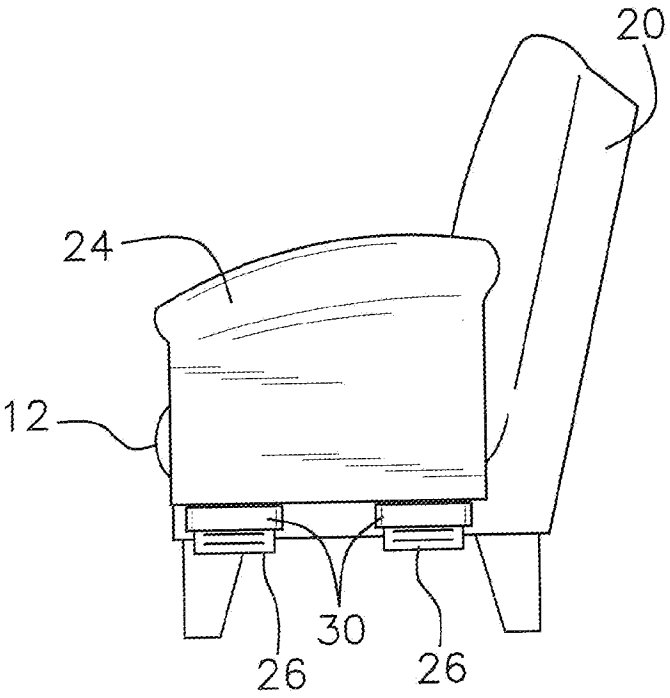
FIG. 4 is a side view of an embodiment of the disclosure.
Figure 3:
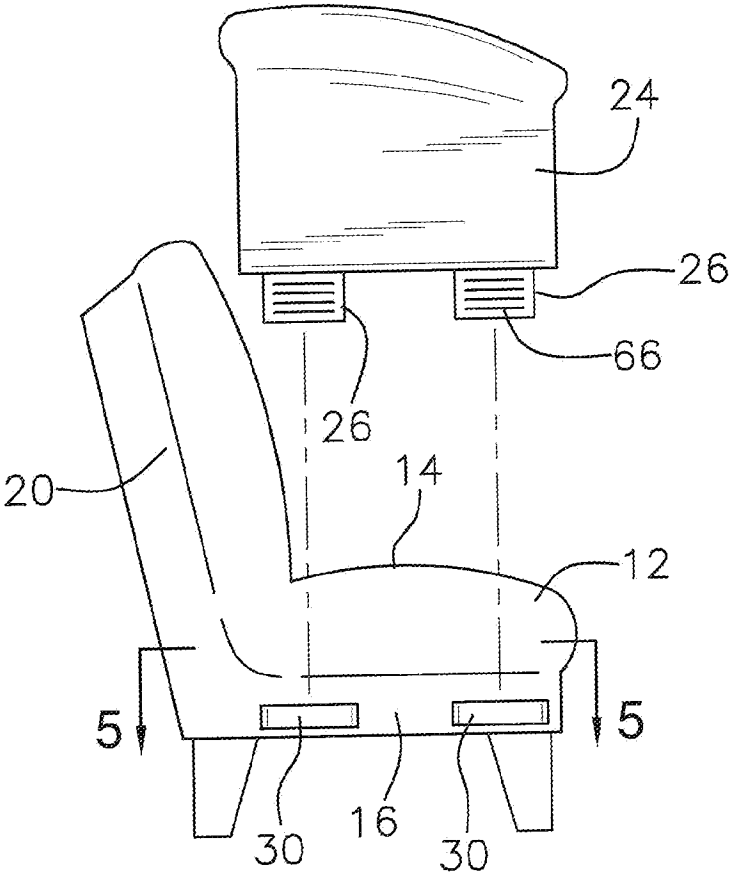
FIG. 3 is a partially exploded side view of an embodiment of the disclosure.
Figure 6:
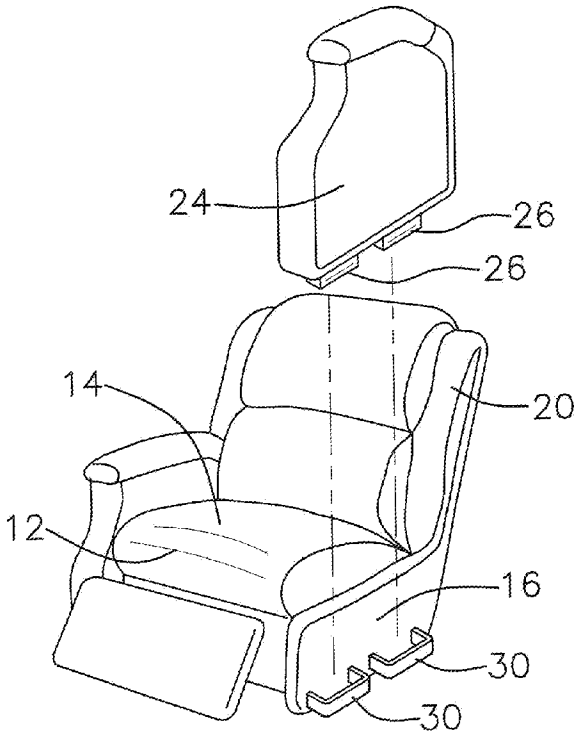
FIG. 6 is a partially exploded top front side view of an embodiment of the disclosure.
Figure 5:
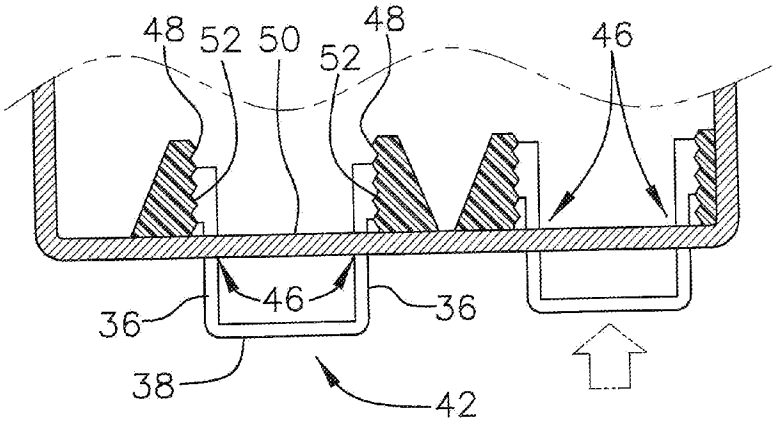
FIG. 5 is a cross-sectional view of an embodiment of the disclosure taken along line 5-5 of FIG. 3.

With reference now to the drawings, and in particular to FIGS. 1 through 6 thereof, a new furniture device embodying the principles and concepts of an embodiment of the disclosure and generally designated by the reference numeral 10 will be described.

As best illustrated in FIGS. 1 through 6, the furniture device 10 generally comprises a base 12 having an upper surface 14 configured for supporting a person thereon. The base 12 has a pair of opposite side faces 16 which may be formed by an outer wall 18 of the base 12 defining the side faces 16 of the base 12. A back 20 is coupled to and extends upwardly from a rear edge 22 of the base 12 defining a chair, sofa, or the like. A pair of arm sections 24 are provided. Each of a plurality of projections 26 is coupled to and extends from an associated one of the arm sections 24. The projections 26 may extend downwardly from a lower edge 28 of the associated arm section 24. Each arm section 24 may have a plurality of the projections 26 positioned in spaced relationship along the lower edge 28.

Each of a plurality of loops 30 is coupled to an associated one of the side faces 16 of the base 12. Each loop 30 may be positioned proximate a bottom edge 32 of the associated side face 16 of the base 12. Each projection 26 is insertable through an associated one of the loops 30 wherein each arm section 24 is removably couplable to the base 12 by seating each projection 26 in the associated loop 30. Each loop 30 may have a pair of elongated side portions 36 and a medial portion 38 coupled to and extending between the side portions 36. A distal end 40 of each of the side portions 36 is coupled to the base 12 such that the medial portion 38 is positioned in spaced relationship to the associated side face 16 of the base 12. Thusly, the medial portion 38 may define a gripping handle 42 when each arm section 24 is disengaged from the associated loop 30.

Each loop 30 may be moved relative to the base 12. Each of a plurality of slots 46 extends into and through the outer wall 18. Each of the slots 46 is positioned on an associated one of the side faces 16 of the base 12. Each side portion 36 of each loop 30 extends through an associated one of the slots 46. Each of a plurality of ridged faces 48 is coupled to and extends from an inward face 50 of the outer wall 18 of the base 12. Each ridged face 48 is positioned adjacent to an associated one of the slots 46. Each side portion 36 has an offset ridged outer surface 52 engaging an associated one of the ridged faces 48 coupled to the outer wall 18 of the base 12. Thus, each loop 30 may be move as desired but interaction between the ridged faces 48 and complementarily ridged outer surfaces 52 inhibit undesired movement. Each ridged face 48 may have a length greater than a length of the ridged outer surface 52 wherein each loop 30 is selectively positionable along the length of the associated ridged face 48. Thus, each loop 30 is positionable to extend a selectable distance from the outer wall 18 providing for a tightened position wherein the loop 30 is moved inwardly to firmly engage the associated projection 26. A plurality of locking ridges 66 may be provided. Each locking ridge 66 is coupled to and extends from an associated one of the projections 26. Each locking ridge 66 is positioned to engage the associated loop 30 when the associated projection 26 is seated in the associated loop 30 to further secure each arm section 24 to the base 12.

In use, the base 12 may be carried in conventional fashion or with the assistance of grasping the loops 30. Each arm section 24 is attached to the base 12 by inserting the projections 26 through the associated loops 30. The arm sections 24 are then secured in place by pushing the loops 30 inwardly into the base 12 allowing the ridged faces 48 to engage the ridged outer surfaces 52 to inhibit the loops 30 from moving outwardly. When desired, sufficient force may be applied to the loops 30 to overcome the engagement between the ridged faces 48 and the ridged outer surfaces 52. The arm sections 24 may then be lifted to remove the projections 26 from the loops 30. The base 12 and back 20 may then again be carried in a tight space more easily without the weight or bulk of the arm sections 24.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A furniture device comprising:

a base having an upper surface configured for supporting a person thereon, said base having a pair of opposite side faces, said base having a bottom edge having a plurality of legs attached thereto;

a back coupled to and extending upwardly from said base;

a plurality of loops, each said loop being coupled to an associated one of said side faces of said base, each of said loops being positioned adjacent to an associated juncture of each of said side faces and said bottom edge and being spaced from said upper surface;

a pair of arm sections; and a plurality of projections, each projection being coupled to and extending from an associated one of said arm sections, each said projection being insertable through an associated one of said loops wherein each said arm section is removably couplable to said base by seating each said projection in said associated loop, each of said arm sections including an interior surface and an exterior surface, said interior surfaces facing and abutting said side faces of said base when said arm sections are coupled to said base, each of said interior and exterior surfaces including a bottom portion and an upper portion, each of said bottom portions of said interior and exterior surfaces being planar;

each said loop having a pair of elongated side portions and a medial portion coupled to and extending between said side portions, distal ends of each of said side portions being coupled to said base wherein said medial portion is positioned in spaced relationship to said associated side face of said base defining a gripping handle when each said arm section is disengaged from said associated loops;

said base having an outer wall defining a said side faces of said base;

a plurality of slots extending into and through said outer wall, each of said slots being positioned on an associated one of said side faces of said base;

a plurality of ridged faces coupled to and extending from an inward face of said outer wall of said base, each said ridged face being positioned adjacent to an associated one of said slots; and each said side portion of each said loop extending through an associated one of said slots, each said side portion having an offset ridged outer surface engaging an associated one of said ridged faces coupled to said outer wall of said base.

2. The device of claim 1, further comprising each said ridged face having a length greater than a length of said ridged outer surface wherein each said loop is selectively positionable along said length of said associated ridged face wherein each said loop is positionable to extend a selectable distance from said outer wall.

3. The device of claim 2, further comprising a plurality of locking ridges, each said locking ridge being coupled to and extending from an associated one of said projections, each said locking ridge being positioned to engage said associated loop when said associated projection is seated in said associated loop.

4. A furniture device comprising:

a base having an upper surface configured for supporting a person thereon, said base having a pair of opposite side faces, said base having an outer wall defining said side faces of said base;

a back coupled to and extending upwardly from said base;

a pair of arm sections;

a plurality of projections, each projection being coupled to and extending from an associated one of said arm sections;

a plurality of loops, each said loop being coupled to an associated one of said side faces of said base, each said loop being positioned proximate a bottom edge of said associated side face of said base, each said projection being insertable through an associated one of said loops wherein each said arm section is removably couplable to said base by seating each said projection in said associated loop, each said loop having a pair of elongated side portions and a medial portion coupled to and extending between said side portions, distal ends of each of said side portions being coupled to said base wherein said medial portion is positioned in spaced relationship to said associated side face of said base defining a gripping handle when each said arm section is disengaged from said associated loops;

a plurality of slots extending into and through said outer wall, each of said slots being positioned on an associated one of said side faces of said base, each said side portion of each said loop extending through an associated one of said slots;

a plurality of ridged faces coupled to and extending from an inward face of said outer wall of said base, each said ridged face being positioned adjacent to an associated one of said slots, each said side portion having an offset ridged outer surface engaging an associated one of said ridged faces coupled to said outer wall of said base, each said ridged face having a length greater than a length of said ridged outer surface wherein each said loop is selectively positionable along said length of said associated ridged face wherein each said loop is positionable to extend a selectable distance from said outer wall; and a plurality of locking ridges, each said locking ridge being coupled to and extending from an associated one of said projections, each said locking ridge being positioned to engage said associated loop when said associated projection is seated in said associated loop.

* * * * *